US008321211B2

(12) United States Patent
Petr

(10) Patent No.: US 8,321,211 B2
(45) Date of Patent: Nov. 27, 2012

(54) SYSTEM AND METHOD FOR MULTI-CHANNEL PITCH DETECTION

(75) Inventor: David W. Petr, Lawrence, KS (US)

(73) Assignee: University of Kansas-KU Medical Center Research Institute, Kansas City, KS (US)

( * ) Notice: Subject to any disclaimer, the term of this patent is extended or adjusted under 35 U.S.C. 154(b) by 896 days.

(21) Appl. No.: 12/380,615

(22) Filed: Mar. 2, 2009

(65) Prior Publication Data

US 2009/0222260 A1 Sep. 3, 2009

Related U.S. Application Data

(60) Provisional application No. 61/067,499, filed on Feb. 28, 2008.

(51) Int. Cl.
*G10L 19/14* (2006.01)

(52) U.S. Cl. ..... 704/207; 704/209; 704/206

(58) Field of Classification Search ..... 704/200–209, 704/216, 217, 500–504
See application file for complete search history.

(56) References Cited

U.S. PATENT DOCUMENTS

| | | | | |
|---|---|---|---|---|
| 7,430,506 | B2 * | 9/2008 | Nam et al. | 704/207 |
| 2004/0158462 | A1 * | 8/2004 | Rutledge et al. | 704/207 |
| 2009/0326958 | A1 * | 12/2009 | Kim et al. | 704/500 |

* cited by examiner

*Primary Examiner* — Huyen X. Vo
(74) *Attorney, Agent, or Firm* — Suiter Swantz pc llo

(57) ABSTRACT

A method and system for multi-channel detection of pitch may comprise one or more of the following steps and/or means therefore: (a) sampling an audio input stream including at least a first channel and a second channel; (b) setting a search frequency for each of the first channel and the second channel; and (c) detecting a pitch of the first channel and a pitch of the second channel.

18 Claims, 12 Drawing Sheets

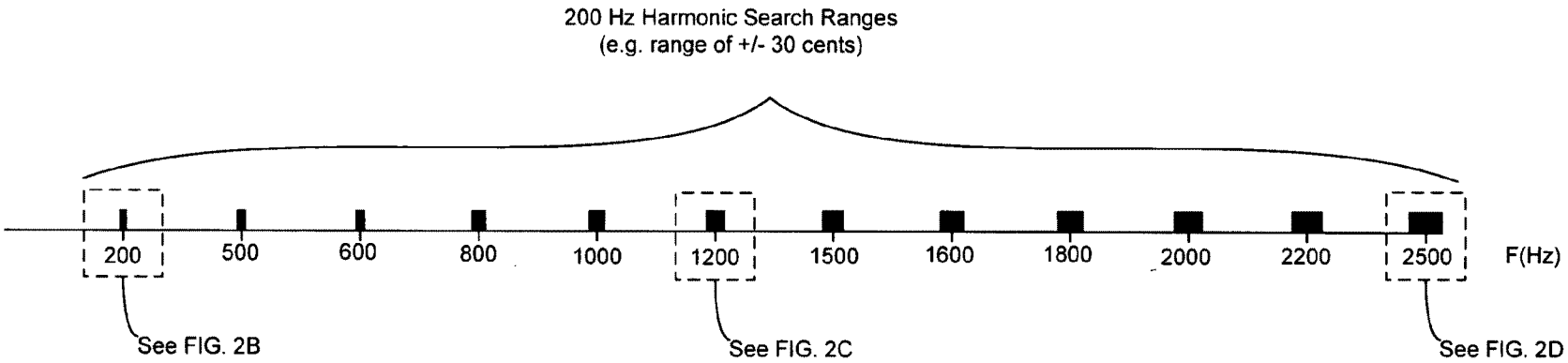
FIG. 2A
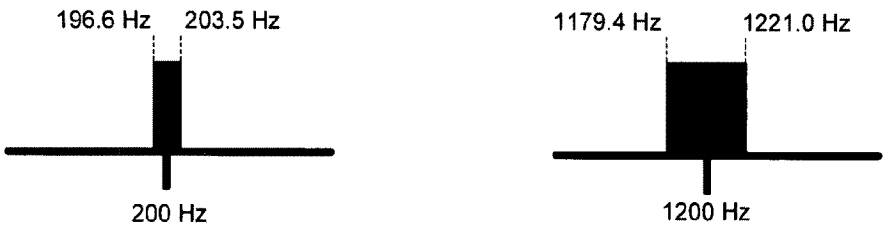
FIG. 2B
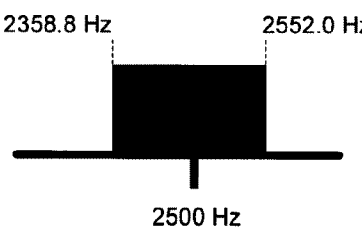
FIG. 2C
FIG. 2D

SYSTEM AND METHOD FOR MULTI-CHANNEL PITCH DETECTION

CROSS REFERENCE TO RELATED APPLICATIONS

The present application claims the benefit under 35 USC §119(e) of U.S. Patent Provisional Application Ser. No. 61/067,499, filed Feb. 28, 2008, which is incorporated herein by reference to the extent such subject matter is not inconsistent herewith.

BACKGROUND

Pitch detection for multiple channels (e.g. a singing duet, an orchestral quartet, etc.) received by a common audio signal reception device (e.g. a microphone) may be desirable to compute a metric of the correlation between the produced pitches and intended target pitches.

SUMMARY

A method and system for multi-channel detection of pitch may comprise one or more of the following steps and/or means therefore: (a) sampling an audio input stream including at least a first channel and a second channel; (b) setting a search frequency for each of the first channel and the second channel; and (c) detecting a pitch of the first channel and a pitch of the second channel.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

FIG. 2 is a graphical representation of harmonic search ranges.

DETAILED DESCRIPTION

Figure 1:
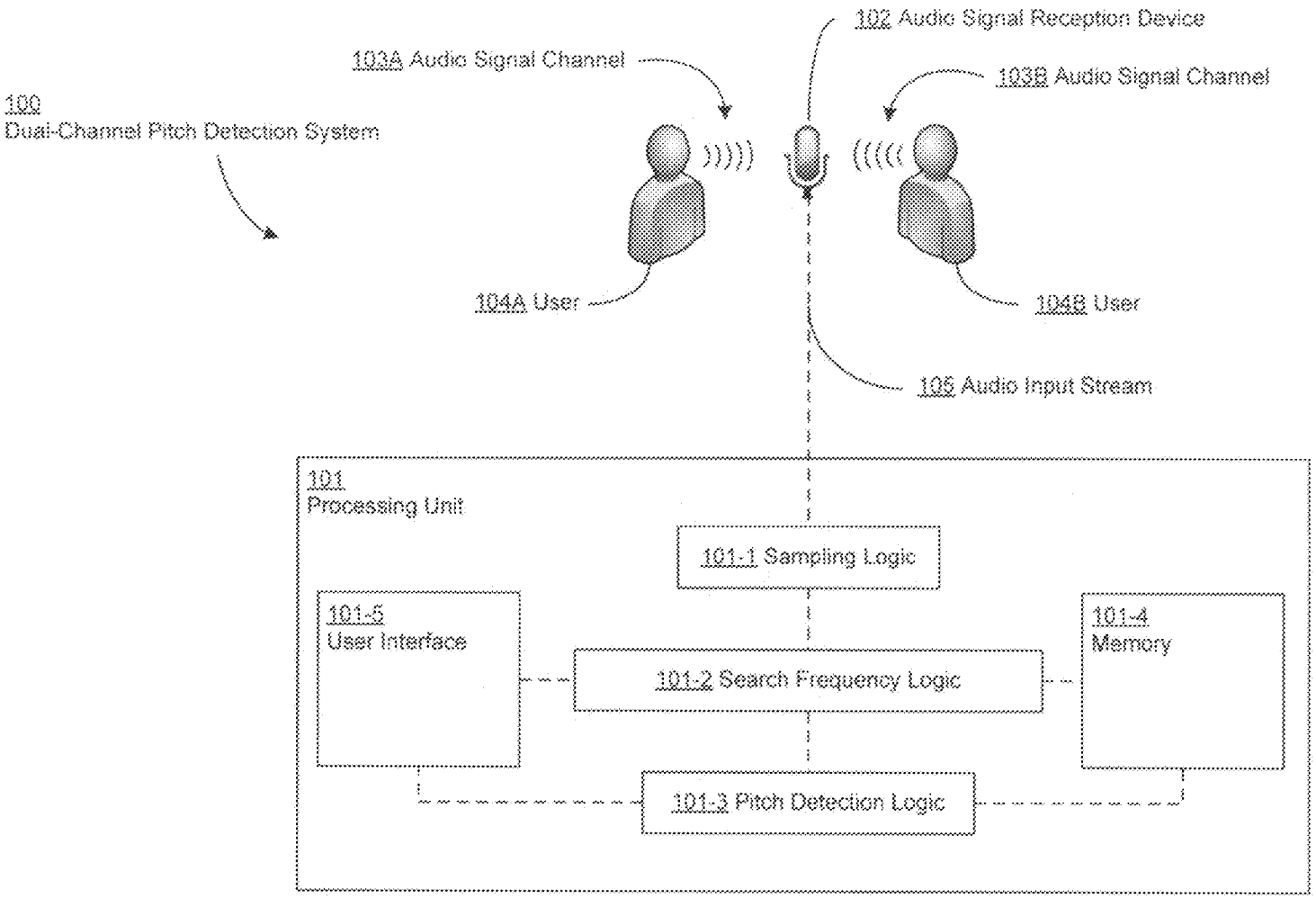
FIG. 1 shows a high-level block diagram of a pitch detection system.

Referring to FIG. 1, a multi-channel pitch detection system 100 is illustrated. The multi-channel pitch detection system 100 may include a processing unit 101 (e.g. a personal digital assistant (PDA), a personal entertainment device such as an XBOX of PLAYSTATION3, a mobile phone, a laptop computer, a tablet personal computer, a networked computer, a computing system comprised of a cluster of processors, a computing system comprised of a cluster of servers, a workstation computer, and/or a desktop computer) operably coupled to an audio signal reception device 102 (e.g. a microphone).

The multi-channel pitch detection system 100 may include a user interface 101-5. The user interface 101-5 may include one or more of a visual feedback module (e.g. a display monitor, LED screen, etc.), an audio feedback module (e.g. a speaker system), a tactile feedback module (e.g. a vibration system) and the like, which may provide a user 104 with feedback regarding the correlation of an audio signal channel 103A associated with a first user 104A and audio signal channel 103B associated with a second user 104B with two or more predetermined pitches (e.g. the musical score for a singing duet).

The audio signal reception device 102 may receive the audio signal channel 103A associated with the first user 104A and the audio signal channel 103B associated with the second user 104B. The user 104A and user 104B may be singers and/or instrumentalists, each attempting to sing and/or play a known sequence of musical notes (e.g. a sequence stored as target pitch data in memory 101-4). While depicted as being received from human user 104A and user 104B, it will be apparent to one of skill in the art that channel 103A and channel 103B may be received by the processing unit 101 from any mechanism for producing audible sound (e.g. audio speakers playing transmitted or recorded sounds, etc.) or, alternatively, from any mechanism providing audio signal data (e.g. prerecorded data encoding audible sounds which may be stored in a storage medium, such as MP3 data files stored on a CD or other recording device).

The channel 103A and channel 103B may be combined into a single audio input stream 105 transmitted by the audio signal reception device 102 to the processing unit 101. The processing unit 101 may receive the audio input stream 105 and pass it to sampling logic 101-1, search frequency logic 101-2, and pitch detection logic 101-3.

Figure 5:
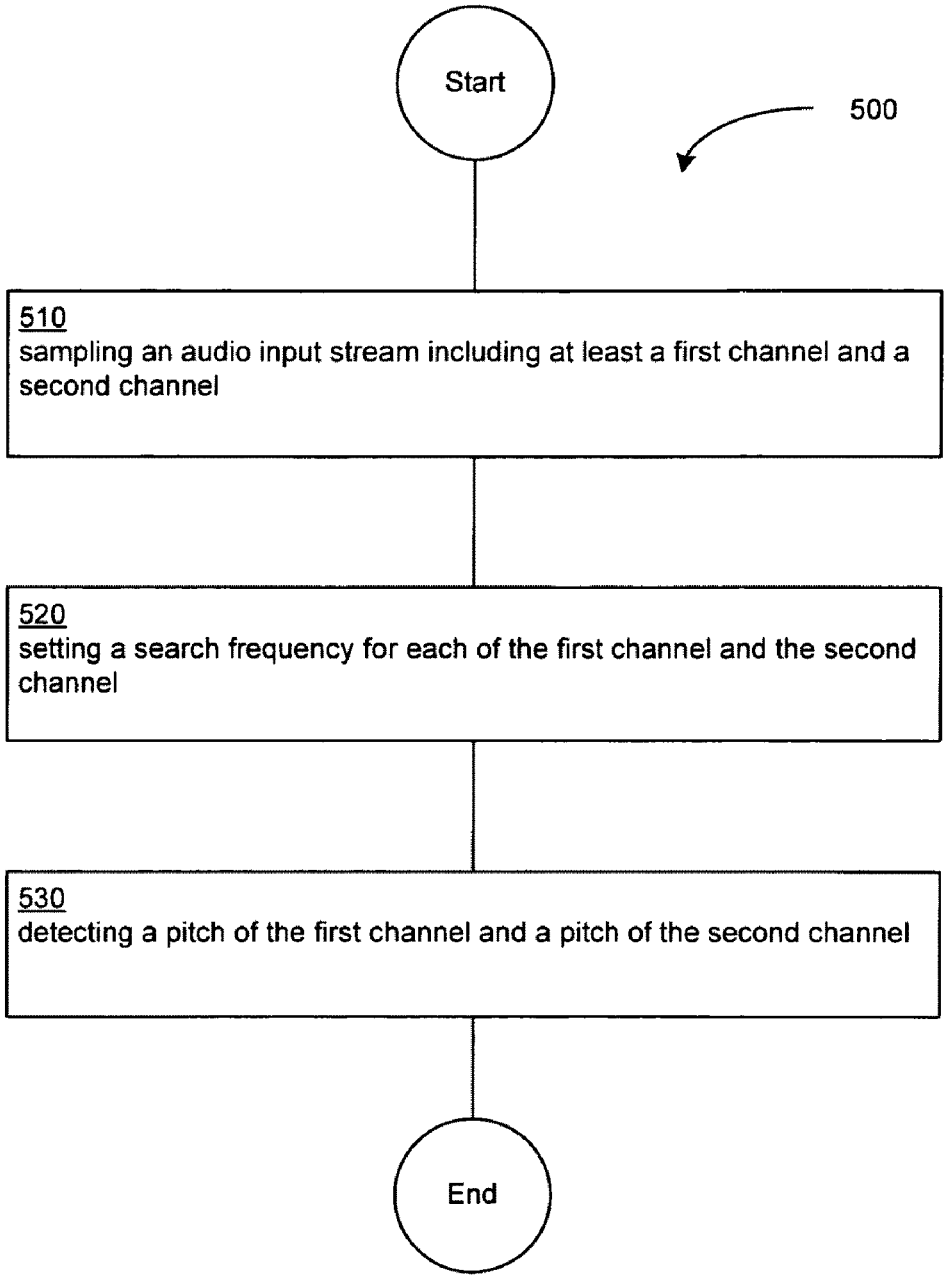
FIG. 5 is a high-level logic flowchart of a process depicting alternate implementations of FIG. 4.

FIG. 5 illustrates an operational flow 500 representing example operations related to multi-channel pitch detection. In FIG. 5 and in following figures that include various examples of operational flows, discussion and explanation may be provided with respect to the above-described examples of FIG. 1, and/or with respect to other examples and contexts. However, it should be understood that the operational flows may be executed in a number of other environments and contexts, and/or in modified versions of FIG. 1. In addition, although the various operational flows are presented in the sequence(s) illustrated, it should be understood that the various operations may be performed in other orders than those that are illustrated, or may be performed concurrently.

After a start operation, the operational flow 500 moves to an operation 510. Operation 510 depicts sampling an audio input stream including at least a first channel and a second channel. For example, as shown in FIG. 1, the audio signal reception device 102 (e.g. a microphone) may receive an audio signal channel 103A associated with a first user 104A and an audio signal channel 103B associated with a second user 104B. The channel 103A and channel 103B may be combined by the audio signal reception device 102 and transmitted to the processing unit 101 as a digitized audio input stream 105. The sampling logic 101-1 of the processing unit 101 may sample the audio input stream 105 (e.g. sampling at a rate of 44,100 samples per second) and group the samples into one or more time segment blocks (e.g. a time segment block may be approximately 0.093 seconds and include 4096 samples).

Figure 6:
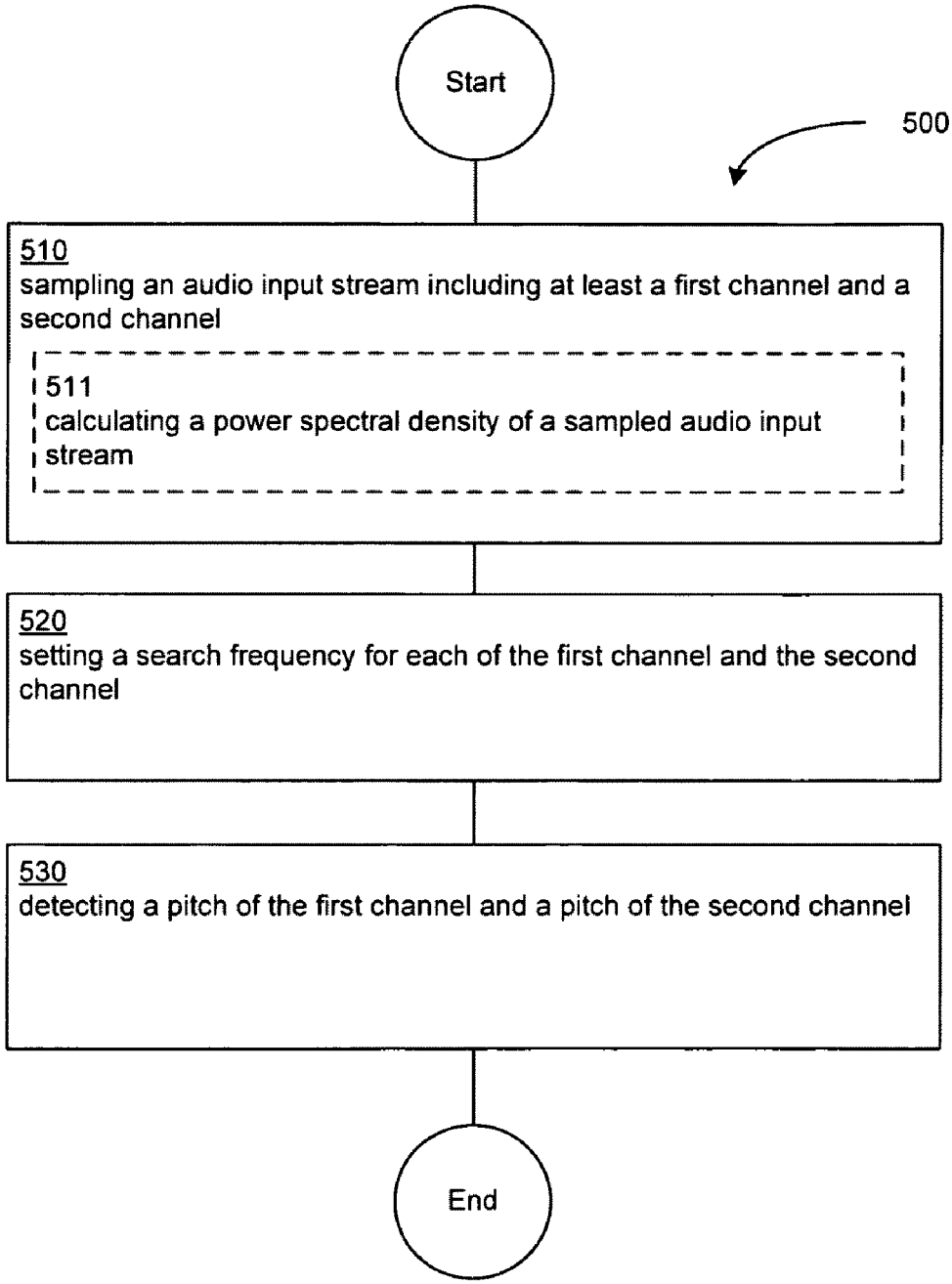
FIG. 6 is a high-level logic flowchart of a process depicting alternate implementations of FIG. 4.

Referring to FIG. 6, operation 510 of the operational flow 500 may include one or more additional operations. The additional operations may include an operation 511. Operation 511 depicts calculating a power spectral density of a sampled audio input stream. For example, as shown in FIG. 1, one or more samples of the audio input stream 105 obtained by sampling logic 101-1 may be converted from a time-domain representation to a frequency-domain representation (e.g. taking a Fast Fourier Transform (FFT) of the samples of the audio input stream 105). In order to enhance the FFT, a windowing function (e.g. a Hanning window function) may be applied to the one or more samples of the audio input stream 105. A power spectral density (PSD) may be calculated by dividing the squared magnitude of the FFT by the time segment block size.

The PSD of an audio input stream 105 may exhibit peaks at or near the harmonics (integer multiples) of a fundamental frequency (e.g. pitch) of a channel 103. As there may be other small, extraneous peaks present in the PSD as well, the PSD may be smoothed one or more times by a smoothing function (e.g. each point of the PSD may be replaced by an average of that magnitude of the subject point, the previous point, and the next point). The PSD may include only the positive-frequency portion of the PSD.

For each time segment block, it may be assumed that the pitch frequency of channel 103A and channel 103B is reasonably stable. Since user 104A and user 104B may not be singing and/or playing exactly on-pitch, a number of search iterations may be required to reliably detect the pitches of channel 103A and channel 103B, respectively.

Referring again to FIG. 5, operation 520 depicts setting a search frequency for each of the first channel and the second channel. For example, as shown in FIG. 1, search frequency logic 101-2 may set a search frequency for the channel 103A and the channel 103B. The initial value of each search frequency may be set to correspond to a frequency associated with a particular target pitch that a user 104A and/or user 104B is attempting to produce. The one or more target pitches may be maintained as target pitch data in a memory 101-4 of the processing unit 101 (e.g. the notes of a particular song that a user 104A and/or user 104B are attempting to produce may be stored in the memory 101-4). Alternatively, the one or more target pitches may be received from a user interface 101-5 (e.g. an electronic piano keyboard, a image scanner configured to scan musical sheet music, and the like).

Operation 530 depicts detecting a pitch of the first channel and a pitch of the second channel. For example, as shown in FIG. 1, the pitch detection logic 101-3 may receive the one or more search frequencies for channel 103A and channel 103B from the search frequency logic 101-2. The pitch detection logic 101-3 may analyze the audio input stream 105 for correspondence of the channel 103A and channel 103B with the search frequencies.

Figure 7:
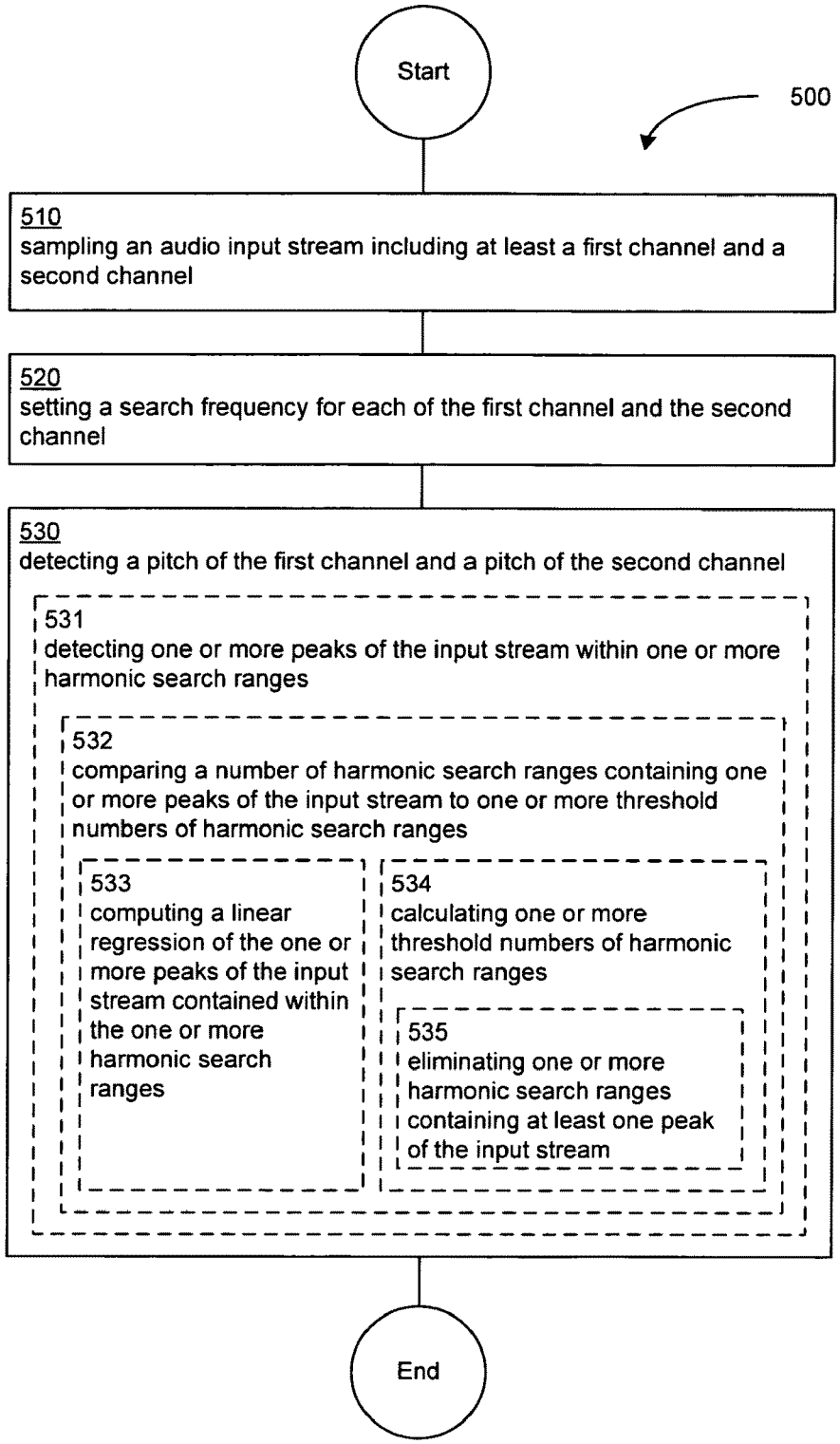
FIG. 7 is a high-level logic flowchart of a process depicting alternate implementations of FIG. 4.

Referring to FIG. 7, the operation 530 may further include an operation 531. Operation 531 depicts detecting one or more peaks of the input stream within one or more harmonic search ranges. For each search frequency, one or more additional (e.g. 12) harmonic search frequencies may also be considered. Referring to FIGS. 2A-2C, one or more segments of the frequency axis (hereafter "harmonic search range") may be established around each harmonic. The harmonic search ranges may extend above and/or below each harmonic by a certain frequency ratio. For example, the logarithmic measure of frequency ratio "cents" may be used to define the size of a harmonic search range:

$$\text{cents}=1200\times\log_2(f_2/f_1)$$

Using a cents measure, each musical octave (i.e. a doubling in pitch frequency) contains 1200 cents. Using the cents measure, each search harmonic search range may extend a fixed number of cents (e.g. 30 cents) above and/or below each search harmonic frequency. The pitch detection logic 101-3 may analyze the PSD of the audio input stream 105 so as to determine the presence and/or absence of one or more peaks of the PSD that occur within the harmonic search ranges associated with a given search frequency.

The Operation 531 may further include an operation 532. Operation 532 illustrates comparing a number of harmonic search ranges containing one or more peaks of the input stream to one or more threshold numbers of harmonic search ranges. For example, the pitch detection logic 101-3 may analyze the PSD of the audio input stream 105 so as to compute a number of PSD peaks resulting from channel 103A and/or channel 103B which are within the current harmonic search ranges associated with channel 103A and/or channel 103B. The pitch detection logic 101-3 may then compare the number of harmonic search ranges containing PSD peaks to a threshold number maintained as data in memory 101-4 or provided as input via user interface 101-5.

If an insufficient number of harmonic search ranges (e.g. less than a defined threshold number) for a given channel 103 contain a PSD peak, the search frequency for that channel 103 may be modified (e.g. increased or decreased). Search frequencies may be adjusted by moving farther and farther away from the original search frequency defined by a target pitch (e.g. by alternating above and below the target pitch). This may be done in such a way that no portion of the frequency axis escapes searching. The search frequency may always be an integer number of "steps" away from the target pitch, where each "step" is smaller than the width of the harmonic search ranges. For example, if the width of a harmonic search range is 60 cents (e.g. plus or minus 30 cents from the search frequency), then the adjustment step for the search frequency should be less than 60 cents (e.g. 25 cents). If a pitch for channel 103A and/or channel 103B is not found within a certain number of steps (e.g. 8) above and/or below the target frequency, the process may terminate for that time segment block.

If a sufficient number of harmonic search ranges for a given channel 103 (e.g. a defined threshold number of harmonic search ranges) contain a PSD peak, the pitch for that channel 103 may be calculated as detected and the pitch may be approximated by the frequency of a peak present within the lowest harmonic search range, if such a peak may be found.

Alternatively, the operation 532 may further include an operation 533. Operation 533 depicts computing a linear regression of the one or more peaks of the input stream contained within the one or more harmonic search ranges. It may be the case that one or more extraneous peaks may exist within the PSD for channel 103A and channel 103B that do not correspond to the pitch frequency. Similarly, even if there is a peak and it does correspond to the pitch for channel 103A and channel 103B, the frequency may be inaccurate due to the granularity of the FFT (upon which the PSD is based). As such, a linear regression technique may be used to compute the measured pitch (i.e. the fundamental frequency) from all of the peak frequencies, which are presumably close to the harmonic frequencies of the pitch of channel 103A and/or channel 103B.

Specifically, k may represent a harmonic (e.g. an integer between 1 and 12) and Peak(k) may represent the frequency of a peak found within the $k^{th}$ harmonic search range. The pitch may then be calculated as the value of the variable Pitch that minimizes the average squared error between k*Pitch and Peak(k). Specifically, letting N be the number of peaks found, Pitch is chosen to minimize the following quantity, where N is the number of peaks found:

$$\frac{1}{N}\sum_{k}(\text{Peak}(k)-k\cdot\text{Pitch})^2$$

Figure 3:
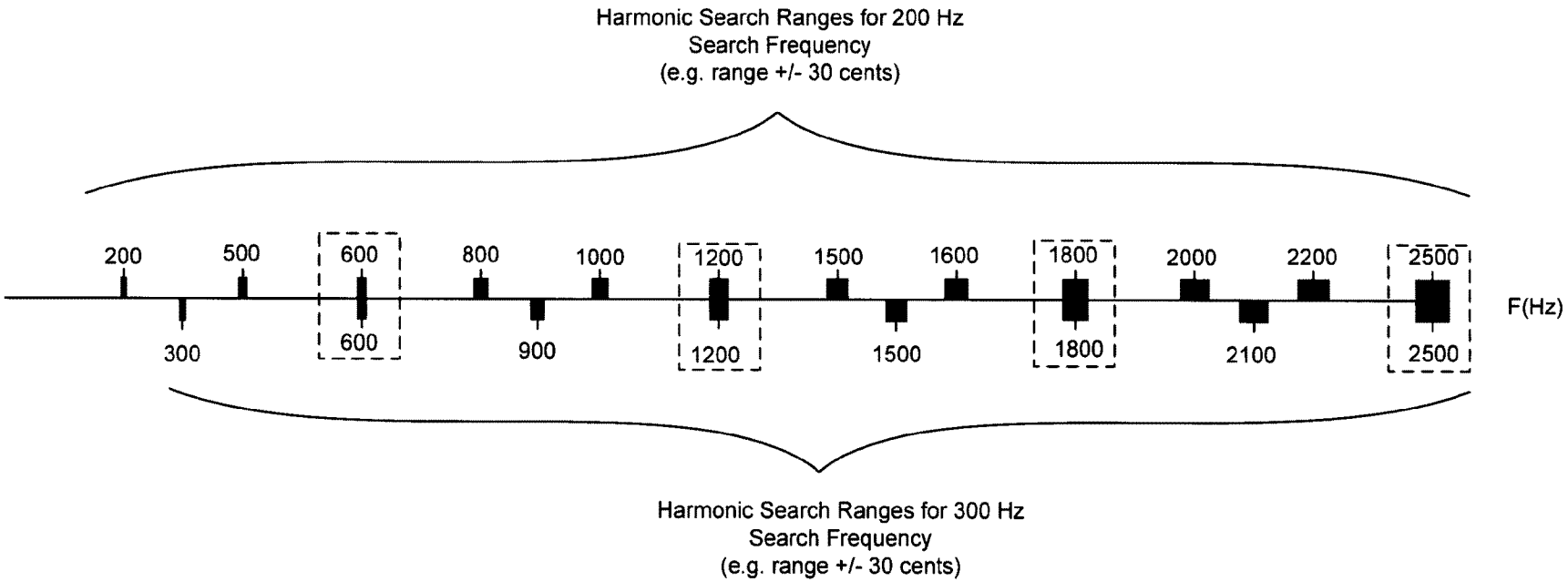
FIG. 3 is a graphical representation of harmonic search ranges.

The operation 532 may further include an operation 534. Operation 534 depicts calculating one or more threshold numbers of harmonic search ranges. The threshold number of harmonic search ranges that must contain a peak in order for the pitch to be considered detected may be different for channel 103A and/or channel 103B. The threshold number of harmonic search ranges may depend on the two search frequencies associated with channel 103A and channel 103B, respectively. For example, in the case where a harmonic search ranges for channel 103A were in increments of 300 Hz (e.g. a search frequency of 300 Hz) and the harmonic search ranges for channel 103B were in increments of 200 Hz (e.g. a search frequency of 200 Hz), harmonics 2, 4, 6, etc. of channel 103A are the same as harmonics 3, 6, 9, etc. of channel 103B, as shown in FIG. 3. As such, if, for example, a peak is found at or near 1200 Hz, it could be harmonic 4 of channel 103B or it could be harmonic 6 of channel 103B, with no clear way to determine which channel 103 it belongs to.

Because of this ambiguity, the operation 534 may include an operation 535. The operation 535 depicts eliminating one or more harmonic search ranges containing at least one peak of the input stream. For example, harmonic search ranges containing one or more peaks that are associated with channel 103A and channel 103B may be eliminated. In the example above utilizing search frequencies of 300 Hz and 200 Hz for channel 103A and channel 103B, respectively, if the actual pitches were 300 Hz and 200 Hz with strong, (e.g. clear peaks existed at all harmonics of channel 103A and channel 103B, respectively), then all of the harmonic search ranges for both would initially have peaks, and, after the elimination of duplicates, all 6 of the 12 remaining harmonic search ranges for channel 103A and all 8 of the 12 remaining harmonic search ranges for channel 103B would have a peak present. Such a condition indicates that the two actual pitches are indeed 300 Hz and 200 Hz, even though only one-half of the 12 harmonic search ranges for channel 103A had a peak (after the elimination of duplicates).

Alternatively, if search frequencies of 300 Hz and 200 Hz for channel 103A and channel 103B, respectively are used and the actual pitches are 315 Hz and 200 Hz, half of the harmonic search ranges for channel 103A and all of the harmonic search ranges for channel 103B may have peaks all resulting from the 200 Hz pitch. However, after the elimination of duplicates, none of the harmonic search ranges for channel 103A would have a peak and 8 of the harmonic search ranges for channel 103B would have a peak. Such a condition would indicate one of the pitches is 200 Hz and the other is not 300 Hz.

As such, the threshold number of harmonic search ranges which must contain peaks for a given channel 103 to be considered detected may be calculated by defining a maximum number of peaks (e.g. 12) and reducing by one for each harmonic of the channel 103 (e.g. channel 103A) that is within a tolerance range (e.g. 40 Hz) of a harmonic of the alternate channel (e.g. channel 103B). The resulting adjusted maximum number of peaks for the given channel 103 may be multiplied by a constant less than 1.0 (e.g. 0.5) and rounded to the nearest integer.

As presented above, a certain number of harmonic search ranges (e.g. 12) may be considered for each of channel 103A and channel 103B. However, this may represent a larger frequency range for one channel 103 than the other as the search frequency for either channel 103A or channel 103B may be greater than the other. To eliminate duplicate peaks as presented above, approximately the overall frequency ranges for channel 103A or channel 103B should be similar. Hence, for initial processing, the number of harmonics considered for the lower frequency channel 103 (e.g. numharmonicsL) may be calculated by the ceiling function:

$$\text{numharmonics}L=\lceil\text{numharmonics}\cdot(\text{search}H/\text{search}L)\rceil$$

where numharmonics is the base number of harmonic search ranges (e.g. 12) and searchH and searchL are the current search frequencies of the higher and lower of the search frequencies for channel 103A or channel 103B. As such, the number of harmonic search ranges for the channel 103 having the lower-frequency search frequency may exceed the base number of harmonic search ranges. For initial processing for the higher-frequency channel 103, the number of harmonic search ranges (e.g. numharmonicsH) may be set as the base number of harmonic search ranges (e.g. 12).

Following elimination of harmonic search ranges containing multiple peaks (as presented above) the number of harmonic search ranges considered for the lower-frequency channel 103 may be reduced to the base number of harmonic search ranges (e.g. 12).

Figure 8:
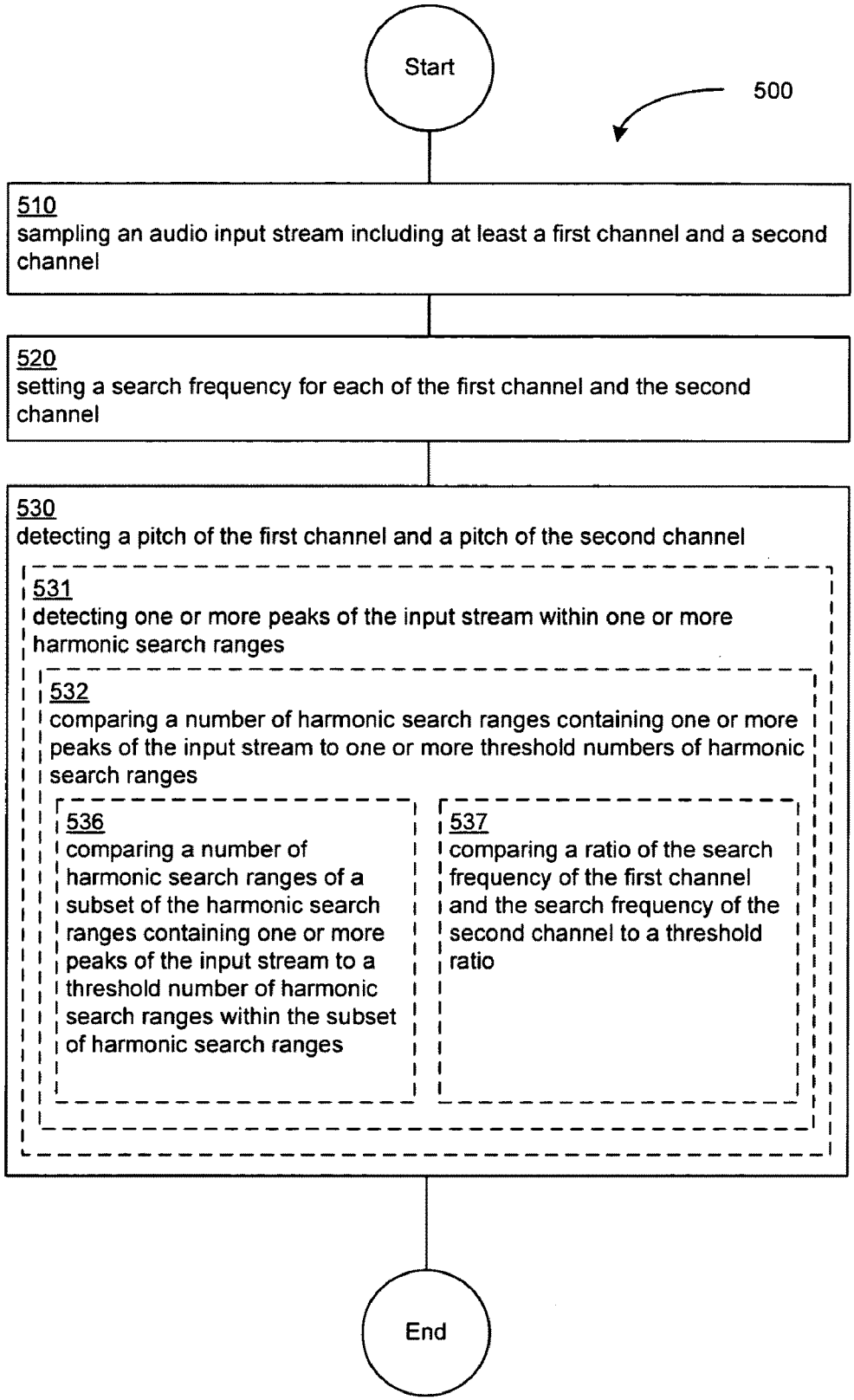
FIG. 8 is a high-level logic flowchart of a process depicting alternate implementations of FIG. 4.

Referring to FIG. 8, as presented above, a pitch for channel 103A and/or channel 103B may be detected as found if a threshold number of harmonic search ranges associated with channel 103A and/or channel 103B contain peaks of the audio input stream 105 (e.g. operation 532). However, it may be the case that, in some situations this condition alone may not accurately detect the pitch for channel 103A and/or channel 103B. For example, if the actual frequency of a given channel 103 is actually 271 Hz but the search frequency is currently 300 Hz, harmonics 9, 10, 11, and 12 of 271 Hz may fall within harmonic search ranges 8, 9, 10, and 11 of the 300 Hz search frequency (assuming the harmonic search ranges extend 30 cents above and below a given harmonic). With the addition of a few anomalous peaks (or peaks from the alternate channel 103) in other harmonic search ranges, the process may (incorrectly) indicate that the actual pitch is approximately 300 Hz.

As such, the operation 532 may further include an operation 536. Operation 536 depicts comparing a number of harmonic search ranges of a subset of the harmonic search ranges containing one or more peaks of the input stream to a threshold number of harmonic search ranges within the subset of harmonic search ranges. For example, the pitch detection logic 101-3 may analyze the PSD of the audio input stream 105 so as to determine the presence and/or absence of one or more peaks of the PSD that occur within the a subset of the harmonic search ranges associated with a given search frequency (e.g. harmonic search ranges associated with the lowest 5 harmonics of the search frequency).

If a sufficient number of the total harmonic search ranges (e.g. 12) and the subset of the total harmonic search ranges (e.g. the first 5) for a given channel 103 contain a PSD peak, the pitch for that channel 103 may be calculated as detected.

Alternatively, it may be the case that the two search frequencies are sufficiently close together (e.g. approximately 50 cents apart). In this case, due to the granularity of the FFT (e.g. 11 Hz), the two peaks for a given low harmonic may merge into a single peak. As a result, one (or both) of the search pitches may not have any peaks in the lower harmonic search ranges. Noting that the granularity effect is diminished at the higher harmonics, the two search frequencies may still each have distinct peaks in the upper harmonic search ranges.

As such, the operation 532 may further include an operation 537. Operation 537 depicts comparing a ratio of the search frequency of the first channel and the search frequency of the second channel to a threshold ratio. For example, the pitch detection logic 101-3 may compute a ratio of the current search frequencies for channel 103A and channel 103B and compare the ratio to a threshold value (e.g. 110 cents).

If a sufficient number of harmonic search ranges associated with a given search frequency for a channel 103 contain peaks (e.g. operation 532) and either: a) a sufficient number harmonic search ranges within the subset of harmonic search ranges for a channel 103 contain peaks (e.g. operation 536) or b) the ratio of the current search frequencies for channel 103A and channel 103B is less than or equal to a threshold value (e.g. operation 537), then the pitch for the channel 103 may be indicated as detected within the current search frequency for the channel 103. The process 500 may then proceed to operation 533 to compute the linear regression of the peaks detected within the current search frequency so as determine the pitch of the channel 103.

Figure 9:
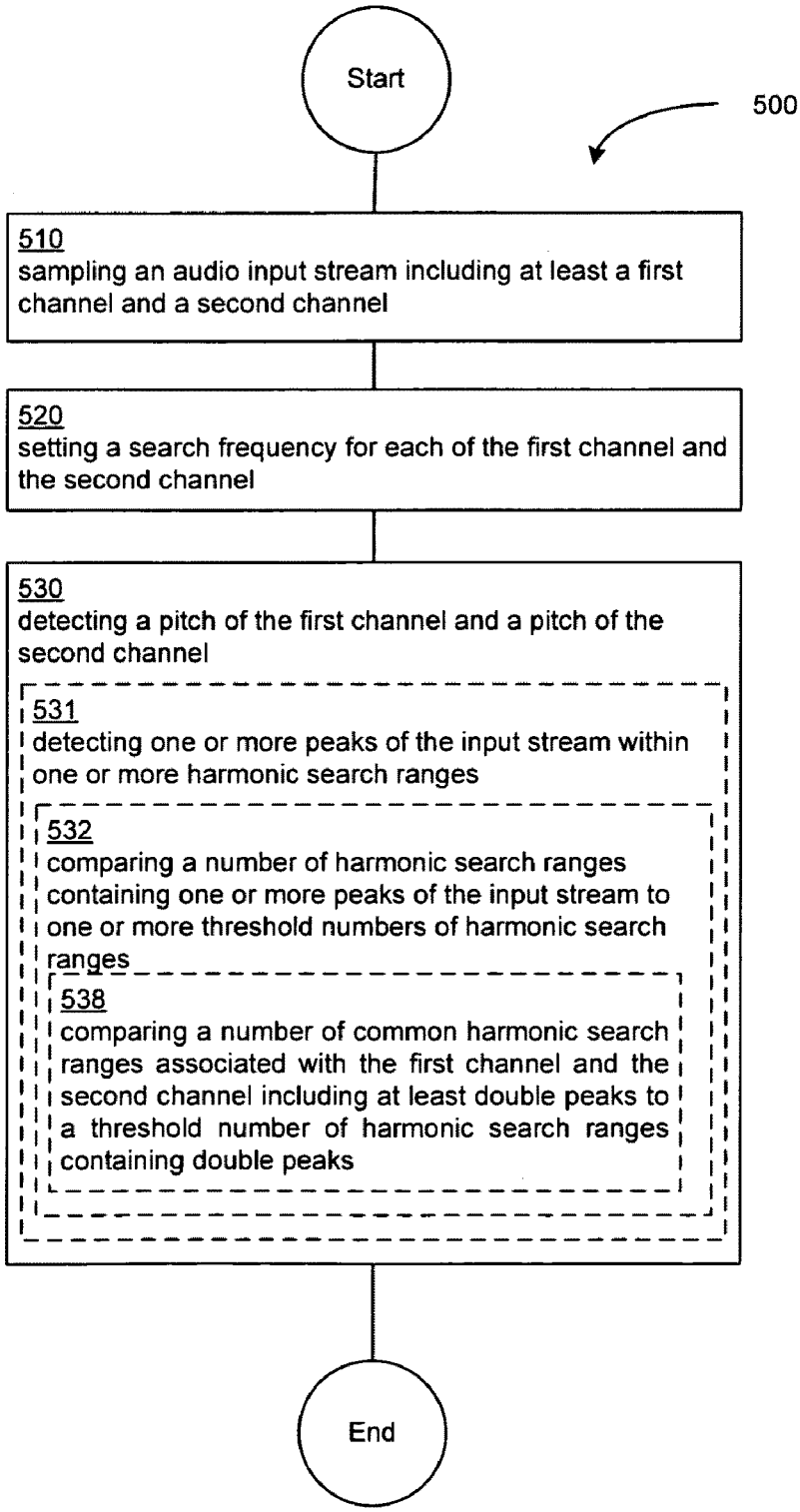
FIG. 9 is a high-level logic flowchart of a process depicting alternate implementations of FIG. 4.

Referring to FIG. 9, it may be the case that the search frequency associated with one channel 103 (e.g. channel 103A) may be the same the search frequency associated with the alternate channel (e.g. channel 103B) (i.e. a unison relationship). In such a case, the channel 103A and channel 103B the may be distinguished only if their pitches are different enough to form double peaks in the PSD.

If an insufficient number of the common harmonic search ranges for a given channel 103 contain at least one PSD peak (e.g. such as is determined in operation 532), it may indicate that neither channel 103A nor channel 103B is near the current common search frequency. The respective search frequencies for channel 103A and channel 103B may be modified and the search process may be restarted using the new search frequencies (e.g. return to operation 520).

If a sufficient number of the common harmonic search ranges contain at least one PSD peak and one or more of those peaks are double peaks, it may indicate that both channel 103A and channel 103B are at or near the current common search frequency.

As such, the operation 532 may further include an operation 538. The operation 538 depicts comparing a number of common harmonic search ranges associated with the first channel and the second channel including at least double peaks to a threshold number of harmonic search ranges containing double peaks. For example, pitch detection logic 101-3 may analyze the PSD of the audio input stream 105 to determine if channel 103A, channel 103B, or both channel 103A and channel 103B are at or near a common search frequency. The number of at least double peaks (e.g. double, triple, quadruple, etc. peaks in one or more harmonic search ranges for either channel 103A or channel 103B) may be determined. The number of harmonic search ranges containing at least double peaks may be compared to a threshold minimum number of double peaks (e.g. 4).

If an insufficient number of double peaks are found within the common harmonic search ranges, it may indicate that either: a) only one channel 103 is at or near the search frequency or b) both channel 103A and channel 103B are in unison at or near the search frequency.

As such, if the pitch for either the channel 103A or the channel 103B was previously detected as found, the pitch associated with the previously detected channel 103 (e.g. channel 103A) may again be detected as found near the current search frequency and the pitch for that channel 103 may then be calculated (e.g. operation 533). The search frequency for the alternate channel (e.g. channel 103B) may be modified and the search process may be restarted using the new search frequency for that channel 103 (e.g. return to operation 520).

Alternatively, if neither the pitch for channel 103A nor channel 103B was previously detected as found, the currently detected pitch may be arbitrarily associated with either channel 103 (e.g. channel 103A) and the pitch for that channel 103 may then be calculated (e.g. operation 533). The search frequency for the alternate channel (e.g. channel 103B) may be modified and the search process may be restarted using the new search frequency that channel 103 (e.g. return to operation 520).

If sufficient double peaks are found within the common harmonic search ranges, one peak may be associated with channel 103A and one peak may be associated with channel 103B and the pitch for both channels 103 may then be calculated (e.g. operation 533) and the process may terminate for the current time segment block Further, it may be the case the search frequency associated with one channel 103 (e.g. channel 103A) may be twice the search frequency associated with the alternate channel (e.g. channel 103B) (i.e. an octave relationship). As illustrated in FIG. 3, each even harmonic associated with a 200 Hz search frequency may correspond to a harmonic associated with a 400 Hz search frequency. Such a possible condition yields several cases and sub-cases to consider.

Figure 10:
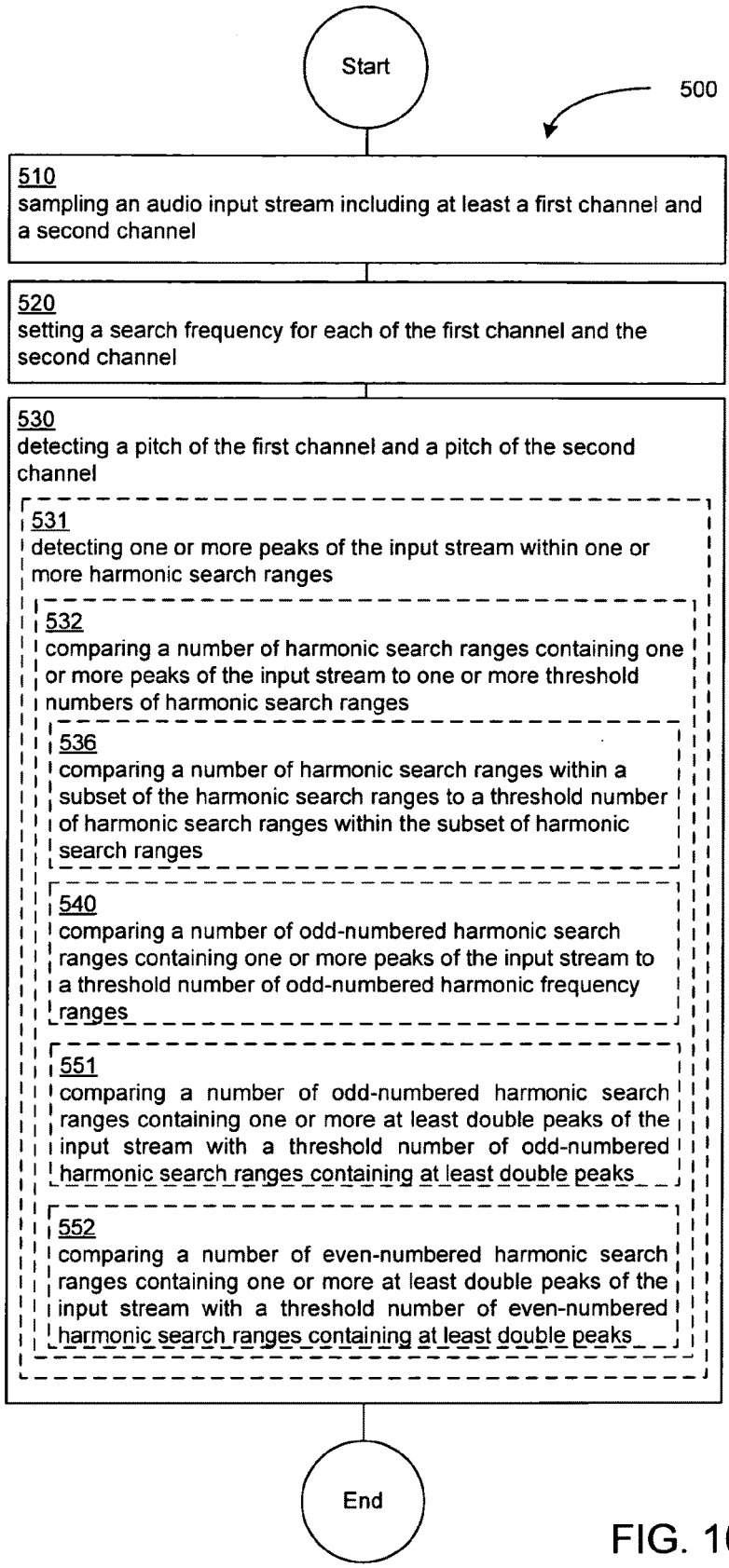
FIG. 10 is a high-level logic flowchart of a process depicting alternate implementations of FIG. 4.

Referring to FIG. 10, in order to differentiate between channels 103 in an octave relationship, operations 510, 520, 530-532 and 536 may again be employed. Particularly, operations 532 and 536 depict comparing a number of harmonic search ranges containing one or more peaks of the input stream to one or more threshold numbers of harmonic search ranges and comparing a number of harmonic search ranges of a subset of the harmonic search ranges containing one or more peaks of the input stream to a threshold number of harmonic search ranges within the subset of harmonic search ranges, respectively, as presented above.

If an insufficient number harmonic search ranges of channel 103A and/or channel 103B contain PSD peaks (e.g. operation 532) or an insufficient number harmonic search ranges of a subset of harmonic search ranges of channel 103A and channel 103B contain PSD peaks (e.g. operation 536), then the search frequency for both channel 103A and channel 103B may be modified and the search process may be restarted using new search frequencies (e.g. return to operation 520).

If a sufficient number of harmonic search ranges of channel 103A and/or channel 103 contain PSD peaks, (e.g. operation 532) and a sufficient number of PSD peaks appear in the subset of harmonic search ranges of channel 103A and/or channel 103B (e.g. operation 536) the process 500 may proceed to operation 540.

Figure 4:
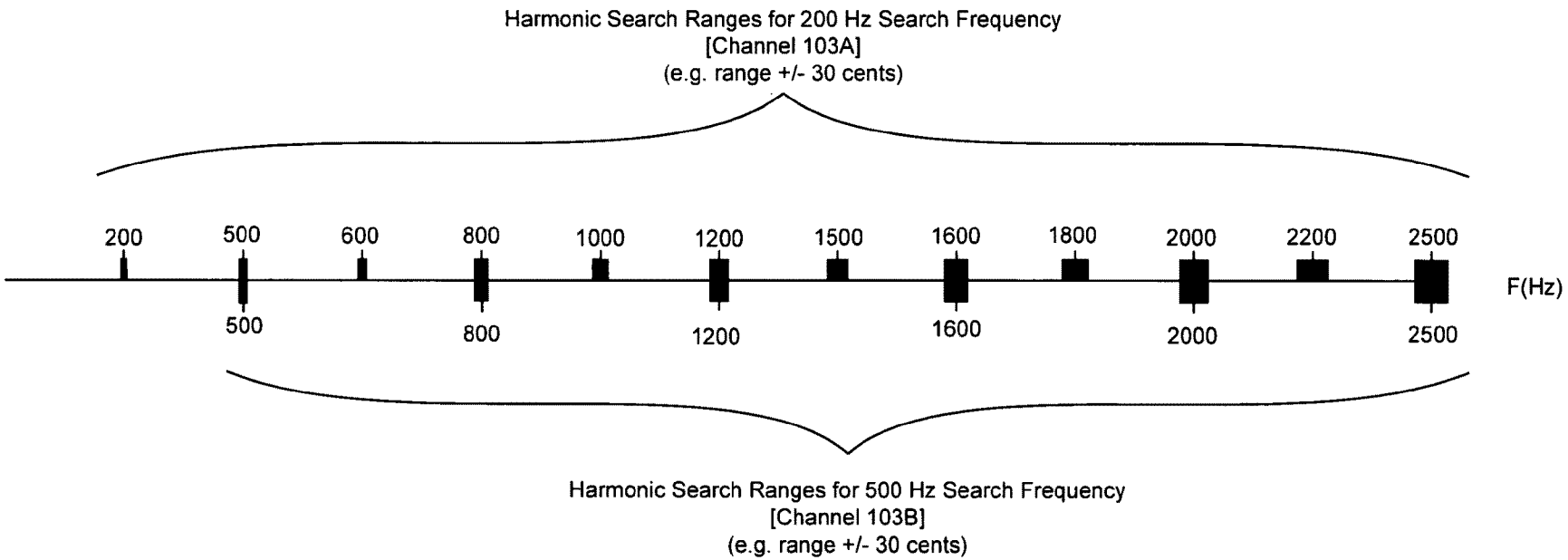
FIG. 4 is a high-level logic flowchart of a process.

Operation 539 depicts comparing a number of odd-numbered harmonic search ranges containing one or more peaks of the input stream to a threshold number of odd-numbered harmonic frequency ranges. For example, as shown in FIG. 1, pitch detection logic 101-3 may analyze the PSD of the audio input stream 105 so as to detect peaks within the odd-numbered harmonic search ranges (e.g. 200 Hz, 600 Hz, 1000 Hz, etc. as shown in FIG. 4) associated with the channel 103 associated the lower search frequency (e.g. the channel 103A having a search frequency at 200 Hz). The number of odd-numbered harmonic search ranges containing one or more peaks of the input stream may be compared to an established threshold number of odd-numbered harmonic search ranges.

If an insufficient number of the odd-numbered harmonic search ranges contain peaks (e.g. less than one fewer than the minimum number of harmonic search ranges that may be calculated through elimination of duplicates as described above), then the channel 103 associated with the higher search frequency (e.g. channel 103B having a search frequency of 400 Hz) may be indicated as found near the higher search frequency and the pitch for that channel 103 may then be calculated (e.g. operation 533). The process 500 may then proceed to operation 541 for determination of the pitch associated with the channel 103 having the lower search frequency (e.g. channel 103A).

If, instead, a sufficient number of the odd-numbered harmonic search ranges contain peaks (e.g. at least one fewer than the minimum number of harmonic search ranges that may be calculated through elimination of duplicates as described above) are detected, the process 500 may proceed to operation 540.

Operation 540 depicts comparing a number of odd-numbered harmonic search ranges containing one or more at least double peaks of the input stream with a threshold number of odd-numbered harmonic search ranges containing at least double peaks. For example, pitch detection logic 101-3 may analyze the PSD of the audio input stream 105 to detect at least double peaks within the odd-numbered harmonic search ranges (e.g. those detected in operation 539). The number of odd-numbered harmonic search ranges containing one or more at least double peaks of the input stream may be compared to an established threshold number of odd-numbered harmonic search ranges.

If a sufficient number of the odd-numbered harmonic search ranges contain double peaks (e.g. greater than or equal to 4), then both channel 103A and channel 103B may be indicated as found near the lower frequency (e.g. 200 Hz), the pitch for that channel 103 may then be calculated (e.g. operation 533) and the process may terminate for the current time segment block.

If an insufficient number of the odd-numbered harmonic search ranges contain double peaks (e.g. less than 4), the channel 103 associated with the lower search frequency (e.g. channel 103A having a search frequency of 200 Hz) may be indicated as found near the lower search frequency and the pitch for that channel 103 may then be calculated (e.g. operation 533). The process 500 may then proceed to operation 541 for determination of the pitch associated with the channel 103 having the higher search frequency (e.g. channel 103B).

Operation 541 depicts comparing a number of even-numbered harmonic search ranges containing one or more at least double peaks of the input stream with a threshold number of even-numbered harmonic search ranges containing at least double peaks. For example, pitch detection logic 101-3 may analyze the PSD of the audio input stream 105 so as to detect at least double peaks within the even numbered harmonic search ranges (e.g. 400 Hz, 800 Hz, 1200 Hz, etc. as shown in FIG. 4) associated with the channel 103 associated the lower search frequency (e.g. the channel 103A having a search frequency at 200 Hz). The number of even-numbered harmonic search ranges containing one or more at least double peaks of the input stream may be compared to an established threshold number of even-numbered harmonic search ranges.

If an insufficient number of odd-numbered harmonic search ranges contain peaks (e.g. as determined in operation 539) and a sufficient number of the even-numbered harmonic search ranges contain double peaks (e.g. greater than or equal to 4), the channel 103 associated with the lower search frequency (e.g. channel 103A) may be indicated as found near the higher frequency (e.g. 400 Hz), the pitch for that channel 103 may then be calculated (e.g. operation 533) and the process may terminate for the current time segment block.

If an insufficient number of odd-numbered harmonic search ranges contain peaks (e.g. as determined in operation 539) and an insufficient number of the even-numbered harmonic search ranges contain double peaks (e.g. less than 4), then the search frequency for the lower frequency channel 103 (e.g. channel 103A) may be modified and the search process may be restarted using the new search frequency for that channel 103 (e.g. return to operation 520).

If a sufficient number of odd-numbered harmonic search ranges contain peaks (e.g. as determined in operation 539), an insufficient number of odd-numbered harmonic search ranges contain at least double peaks (e.g. as determined in operation 540), and an insufficient number of the even-numbered harmonic search ranges contain double peaks (e.g. less than 4), then the search frequency for the higher frequency channel 103 (e.g. channel 103B) may be modified and the search process may be restarted using the new search frequency (e.g. return to operation 520).

If a sufficient number of odd-numbered harmonic search ranges contain peaks (e.g. as determined in operation 539), an insufficient number of odd-numbered harmonic search ranges contain at least double peaks (e.g. as determined in operation 540), and a sufficient number of the even-numbered harmonic search ranges contain double peaks (e.g. less than 4), then the channel 103 associated with the higher search frequency (e.g. channel 103B) may be indicated as found near the higher frequency (e.g. 400 Hz), the pitch for that channel 103 may then be calculated (e.g. operation 533) and the process may terminate for the current time segment block.

Figure 11:
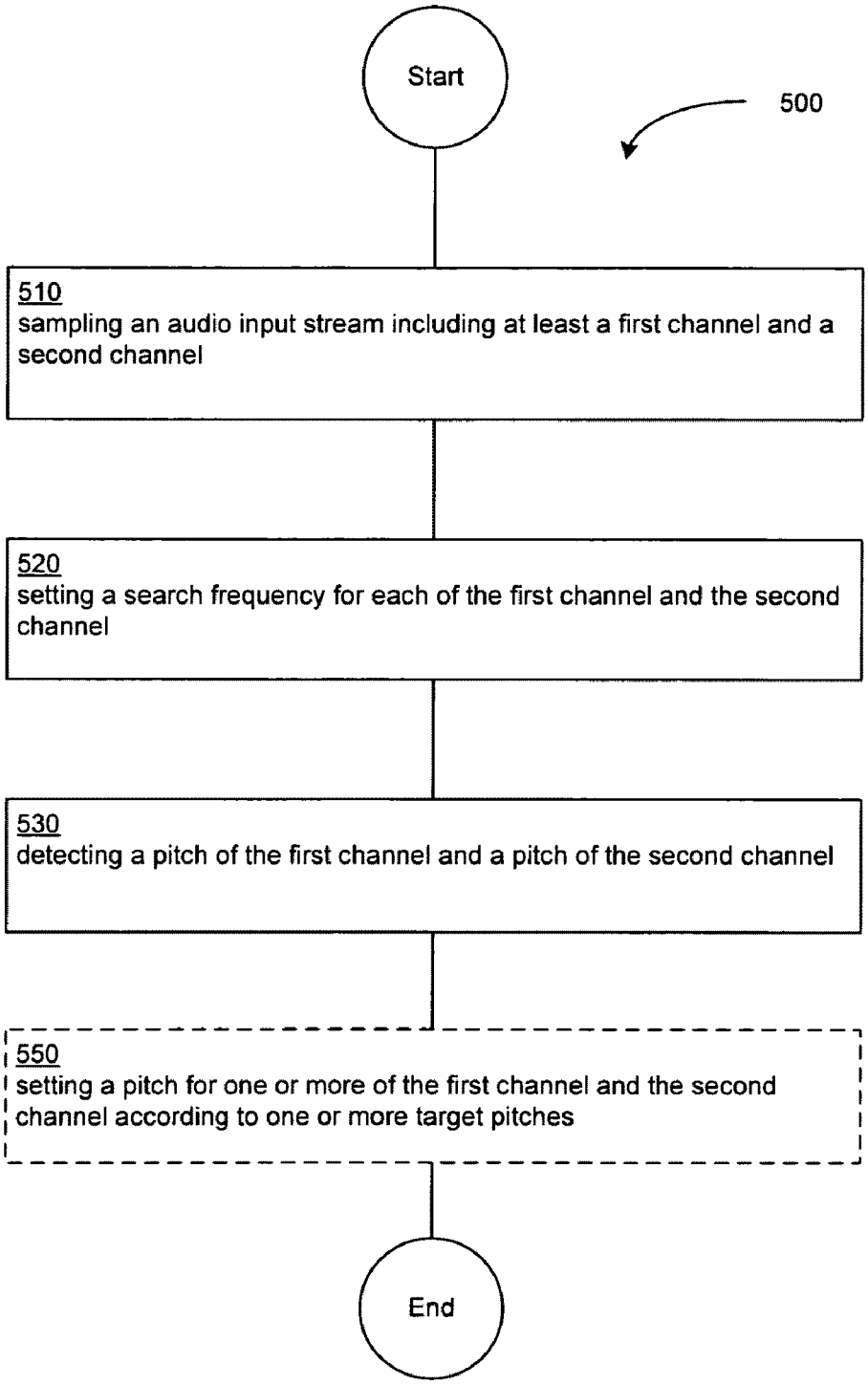
FIG. 11 is a high-level logic flowchart of a process depicting alternate implementations of FIG. 4.

Referring to FIG. 11, it may be the case that, following the iterative process detailed above, a pitch may not be detected for either channel 103A or channel 103B. As such, operation flow 500 may further include an operation 550. Operation 550 depicts setting one or more pitches for one or more of the first channel and the second channel according to one or more target pitches.

For example, it may be the case that the target pitches for a given time segment block are in an octave relationship (e.g. the pitch of channel 103B=2× the pitch of channel 103A). If the process detailed above detected a pitch for the lower frequency channel 103 (e.g. channel 103A) but not for the higher frequency channel 103 (e.g. channel 103B), the pitch for the higher-frequency channel 103 may be set as 2× the lower frequency based on the known intended target pitches.

Similarly, it may be the case that the target pitches for a given time segment block are in a unison relationship (e.g. the pitch of channel 103B=the pitch of channel 103A). If the process detailed above detected a pitch for the lower frequency channel 103 (e.g. channel 103A) but not for the higher frequency channel 103 (e.g. channel 103B), the pitch for the higher-frequency channel 103 may be set equal to the lower frequency based on the known intended target pitches.

Alternatively, if the target pitches are in either a unison or an octave relationship and the process detailed above detected a pitch for the higher frequency channel 103 (e.g. channel 103B) but not for the lower frequency channel 103 (e.g.

channel 103A), the pitch for the lower-frequency channel 103 may be set equal to the higher frequency based on the known intended target pitches.

It may also be the case that only one pitch for either channel 103A or channel 103B may be detected but that detected pitch may actually be closer to the target pitch for the other channel 103. If only the pitch associated with the higher frequency channel (e.g. channel 103B) is found but its value is closer to the target pitch for the lower frequency channel (e.g. channel 103A), then the higher frequency channel may be designated as the lower frequency channel. Similarly, if only the pitch associated with the lower frequency channel (e.g. channel 103A) is found but its value is closer to the target pitch for the higher frequency channel (e.g. channel 103B), then the lower frequency channel may be designated as the higher frequency channel.

Figure 12:
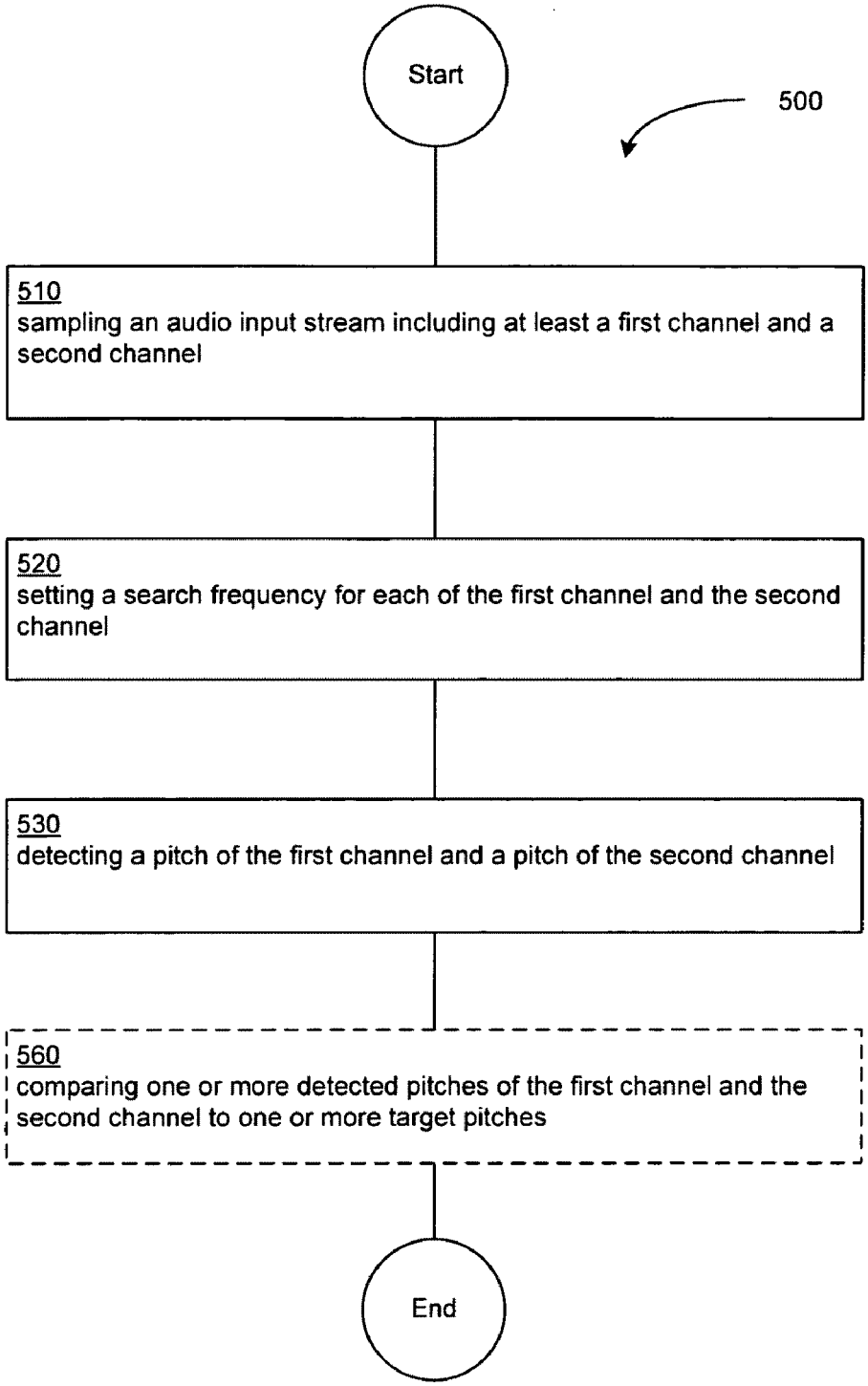
FIG. 12 is a high-level logic flowchart of a process depicting alternate implementations of FIG. 4.

Referring to FIG. 12, following detection of the pitches for channel 103A and channel 103B, it may be desirable to determine the degree of correlation between the detected pitches and the intended target pitches that user 104A and user 104B are attempting to reproduce.

As such, operation flow 500 may further include an operation 560. Operation 560 depicts comparing one or more detected pitches of the first channel and the second channel to one or more target pitches. For example, the pitch detection logic 101-3 may receive data representing the target pitch from memory 101-4. The correlation between the target pitch data and the one or more detected pitches may be provided to user 104A and user 104B via user interface 101-5. For example, the degree of correlation may be reflected in a graphical manner by displaying a graph (e.g. a moving timeline graph) of one or more target pitches superimposed with the one or more detected pitches. Alternatively, the degree of correlation may be provided as a score reflecting the degree of correlation (e.g. a detected pitch within a certain range (e.g. ±10 cents) of a target pitch results in a certain number of points which may be accumulated over multiple time segment blocks).

Although the users 103 are shown/described herein as two illustrated figures, those skilled in the art will appreciate that a user 103 may be representative of a human user, a robotic user (e.g., computational entity), and/or substantially any combination thereof (e.g., a user may be assisted by one or more robotic agents). In addition, a user 103, as set forth herein, although shown as a single entity may in fact be composed of two or more entities.

Although the above process and system has been described with respect to dual-channel pitch detection, such descriptions are merely for exemplary purposes and should not be read to limit, in any way, the extensibility of the present disclosures to related multi-channel systems.

Those having skill in the art will recognize that the state of the art has progressed to the point where there is little distinction left between hardware and software implementations of aspects of systems; the use of hardware or software is generally (but not always, in that in certain contexts the choice between hardware and software can become significant) a design choice representing cost vs. efficiency tradeoffs. Those having skill in the art will appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations will typically employ optically oriented hardware, software, and or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

In a general sense, those skilled in the art will recognize that the various aspects described herein which could be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

What is claimed is:

1. A method comprising:

sampling an audio input stream including at least a first channel and a second channel;

setting a search frequency for each of the first channel and the second channel; and detecting a pitch of the first channel and a pitch of the second channel, wherein the detecting a pitch of the first channel and a pitch of the second channel further comprises:

detecting one or more peaks of the input stream within one or more harmonic search ranges; and comparing a number of harmonic search ranges containing one or more peaks of the input stream to one or more threshold numbers of harmonic search ranges.

2. The method of claim 1, further comprising:

computing a linear regression of the one or more peaks of the input stream contained within the one or more harmonic search ranges.

3. The method of claim 1, further comprising:
calculating one or more threshold numbers of harmonic search ranges.

4. The method of claim 1, further comprising:
eliminating one or more harmonic search ranges containing at least one peak of the input stream.

5. The method of claim 4, further comprising:
comparing a number of common harmonic search ranges associated with the first channel and the second channel including at least double peaks to a threshold number of harmonic search ranges containing double peaks.

6. The method of claim 1, wherein the comparing a number of harmonic search ranges containing one or more peaks of the input stream to one or more threshold numbers of harmonic search ranges further comprises:
comparing a number of harmonic search ranges of a subset of the harmonic search ranges containing one or more peaks of the input stream to a threshold number of harmonic search ranges within the subset of harmonic search ranges.

7. The method of claim 6, further comprising:
comparing a number of odd-numbered harmonic search ranges containing one or more peaks of the input stream to a threshold number of odd-numbered harmonic frequency ranges.

8. The method of claim 7, further comprising:
comparing a number of odd-numbered harmonic search ranges containing one or more at least double peaks of the input stream with a threshold number of odd-numbered harmonic search ranges containing at least double peaks.

9. The method of claim 7, further comprising:
comparing a number of even-numbered harmonic search ranges containing one or more at least double peaks of the input stream with a threshold number of even-numbered harmonic search ranges containing at least double peaks.

10. The method of claim 1, further comprising:
comparing a ratio of the search frequency of the first channel and the search frequency of the second channel to a threshold ratio.

11. The method of claim 1, further comprising:
setting one or more pitches for one or more of the first channel and the second channel according to one or more target pitches.

12. The method of claim 1, further comprising:
comparing one or more detected pitches of the first channel and the second channel to one or more target pitches.

13. A system comprising:
means for sampling an audio input stream including at least a first channel and a second channel;
means for setting a search frequency for each of the first channel and the second channel; and
means for detecting a pitch of the first channel and a pitch of the second channel,
wherein the means for detecting a pitch of the first channel and a pitch of the second channel further comprises:
means for detecting one or more peaks of the input stream within one or more harmonic search ranges; and
means for comparing a number of harmonic search ranges containing one or more peaks of the input stream to one or more threshold numbers of harmonic search ranges.

14. The system of claim 13, further comprising:
means for setting one or more pitches for one or more of the first channel and the second channel according to one or more target pitches.

15. The system of claim 13, further comprising:
means for comparing one or more detected pitches of the first channel and the second channel to one or more target pitches.

16. A non-transitory computer readable medium including computer readable instructions for execution of a process by a processor, the process comprising:
sampling an audio input stream including at least a first channel and a second channel;
setting a search frequency for each of the first channel and the second channel; and
detecting a pitch of the first channel and a pitch of the second channel, wherein the detecting a pitch of the first channel and a pitch of the second channel further comprises:
detecting one or more peaks of the input stream within one or more harmonic search ranges; and
comparing a number of harmonic search ranges containing one or more peaks of the input stream to one or more threshold numbers of harmonic search ranges.

17. The non-transitory computer readable medium of claim 16, the process further comprising:
setting one or more pitches for one or more of the first channel and the second channel according to one or more target pitches.

18. The non-transitory computer readable medium of claim 16, the process further comprising:
comparing one or more detected pitches of the first channel and the second channel to one or more target pitches.

* * * * *